United States Patent [19]

Watkins

[11] 4,311,227

[45] Jan. 19, 1982

[54] VENDING SYSTEM FOR FLORAL TYPE PRODUCTS

[76] Inventor: Kenneth M. Watkins, 3301 Starmount Dr., Raleigh, N.C. 27604

[21] Appl. No.: 119,402

[22] Filed: Feb. 7, 1980

Related U.S. Application Data

[63] Continuation of Ser. No. 858,091, Dec. 8, 1977, abandoned.

[51] Int. Cl.[3] ..... G07F 7/04

[52] U.S. Cl. ..... 194/4 C; 221/5

[58] Field of Search ..... 194/10, 4 C, 1 A, 9, 194/9 T, 51, 59, 65, 2; 221/150 HC, 5

[56] References Cited

U.S. PATENT DOCUMENTS 2,800,988 12/1931 Timms ..... 194/0.02
2,808,918 10/1957 Shepard, Jr. et al. ..... 194/1 A
2,811,403 10/1957 Barker et al. ..... 194/10 X
2,875,878 3/1959 Hoban ..... 194/10
3,170,554 2/1965 Davis ..... 221/150 HC

*Primary Examiner*—Stanley H. Tollberg
*Attorney, Agent, or Firm*—John G. Mills, III; Larry L. Coats; William R. Hinds

[57] ABSTRACT

This invention is a vending system for floral type products and includes a plurality of product containing cubicles with an access door operatively associated with each. A controllable locking structure is used with each door and is connected to a validator for accepting and totaling money. Selectors are provided for choosing the appropriate cubicle door to be opened and these selectors are resettable to a different amount of money by simply resetting a dial on the exterior backside of the panel.

6 Claims, 8 Drawing Figures

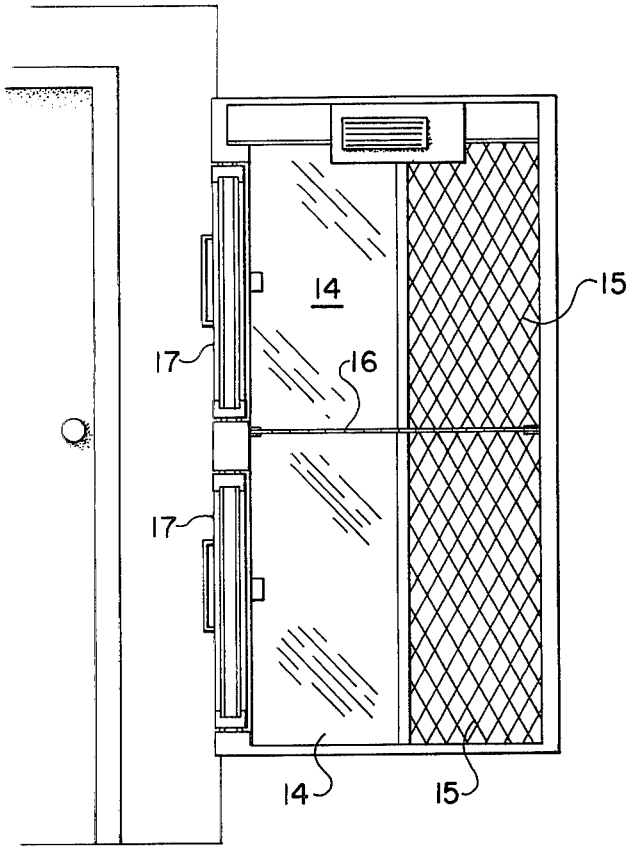
FIG.2
FIG.3
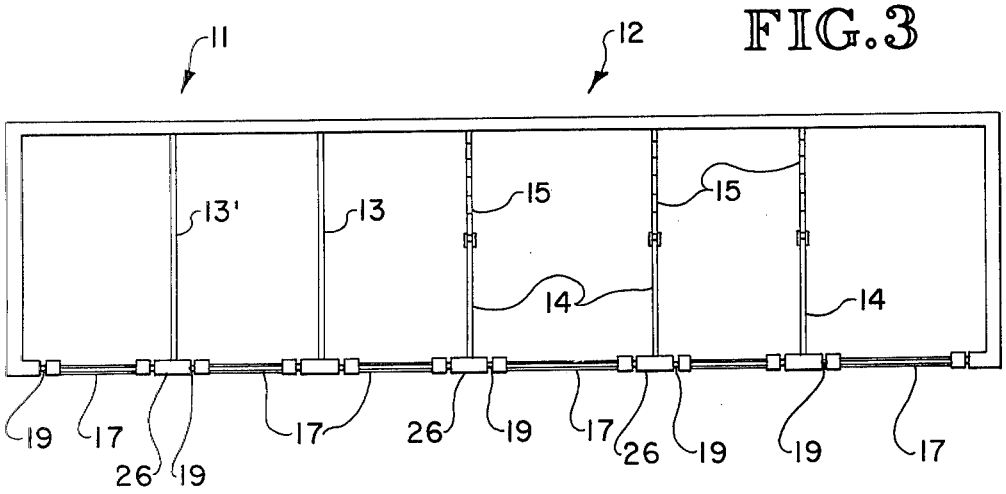

VENDING SYSTEM FOR FLORAL TYPE PRODUCTS

This is a continuation of application Ser. No. 858,091, filed Dec. 8, 1977, now abandoned.

FIELD OF INVENTION

This invention relates to automatic vending systems and more particularly to vending systems for live florist type products such as flower and plant arrangements.

BACKGROUND OF INVENTION

In the past various types of vending systems have been developed, mostly for food and drink type products. Many of these systems are refrigerated, soft drink machines and ice cream sandwich dispensers being probably the most commonly known.

Most vending devices, particularly those that are heated or cooled are relatively small and compact in size and mechanically rather sophisticated and complex. None of the prior vending and dispensing systems known to the Inventor have been capable of accomplishing what he accomplishes with the simplicity and efficiency inherent in the present invention.

In view of the above, it is an object of the present invention to provide a simple and yet highly efficient means for vending live products such as flower and plant arrangements.

Another object of the present invention is to provide a dispensing system wherein both heated and cooled areas are provided for different types of live plants for nonattendant sales vending.

Another object of the present invention is to provide a vending system wherein each of a plurality of selections can be varied in price.

Another object of the present invention is to provide a flower type vending system wherein the product is static until removed after selection and payment.

Another object of the present invention is to provide a vending system which has a plurality of products with varying prices, such prices being readily changeable on a remote control panel.

Another object of the present invention is to provide, in a flower type vending system, an emergency interior lock disengagement means.

Other objects and advantages of the present invention will become apparent and obvious from a study of the following description and the accompanying drawings which are merely illustrative of such invention.

BRIEF DESCRIPTION OF DRAWINGS

FIG. 2 is a sectional view taken through lines 2—2 of FIG. 1;

FIG. 3 is a sectional view taken through lines 3—3 of FIG. 1;

DETAILED DESCRIPTION OF PREFERRED EMBODIMENT

Figure 1:
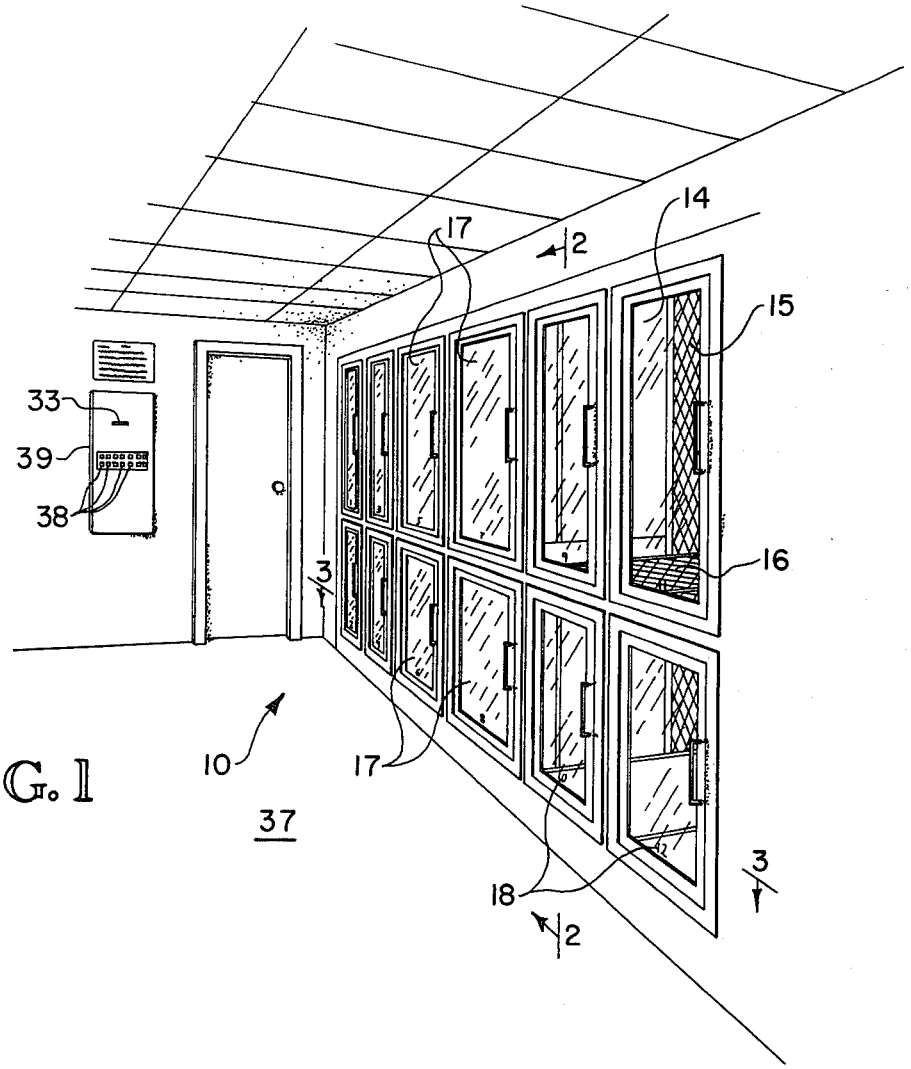
FIG. 1 is a perspective view of the vending system of the present invention installed in a static structure.
Figure 8:
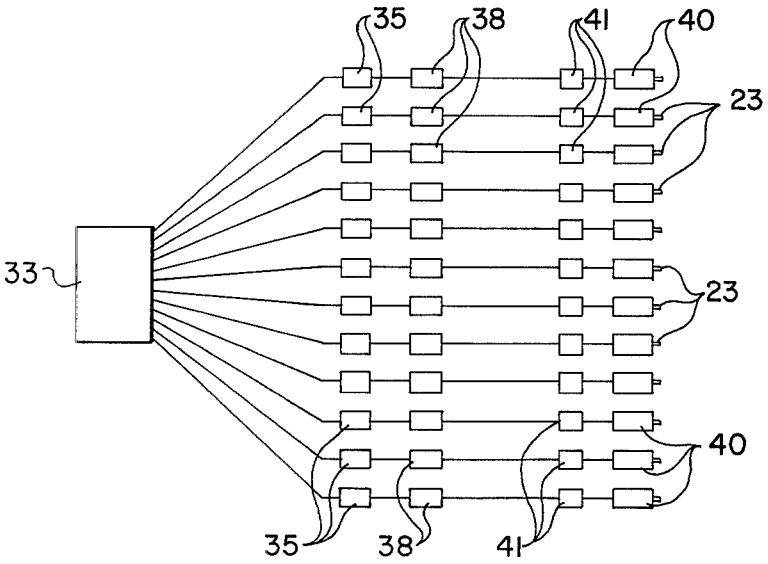
FIG. 8 is a schematic view of the control system of the present invention.
Figure 6:
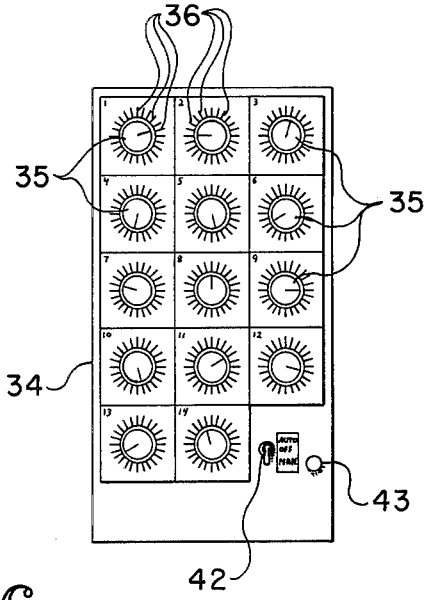
FIG. 6 is an elevational view of the remote programming panel of the present invention.
Figure 7:
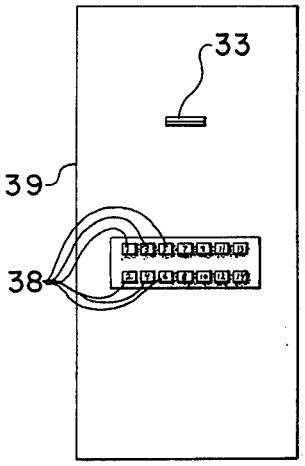
FIG. 7 is an elevational view of the customer operated selection panel of the present invention.

With further reference to the drawings, the vending system of the present invention, indicated generally at 10, includes a plurality of box-like enclosures separated by vertical and horizontal partitions. There is preferably an heated area indicated generally at 11 and a cooled area indicated generally at 12. These two areas of the system of the present invention are separated by a solid vertical wall 13 constructed of preferably a transparent material such as glass.

Between each of the box-like cubicles is the heated area or the cooled area are preferably disposed vertical partitions which are composed half of solid, preferably transparent material 14 and half of a mesh material 15. Paired upper and lower cubicles are preferably separated by a horizontal partition 16 composed of a mesh material similar to partition 15. The horizontal partitions, as can readily be noted from the drawings, particularly FIG. 2, act as the floor for the upper cubicle and the ceiling for the lower cubicle.

The purpose for the mesh horizontal partitions 16 and the vertical portions 15 between the adjoining cubicles within the cooled area and the various cubicles within the heated area is to allow air circulation between the cubicles within the confines of such areas.

Glass or other transparent material is used in portion 14 of the vertical partitions in question for two reasons. First, it allows a view from one cubicle to the next thus giving a more open effect to the vending system and aids in viewing from one cubicle to the next while at the same time preventing a person from tripping the locking mechanism in the adjoining cubicle when one cubicle has already been opened.

To heat and cool areas 11 and 12, any suitable system (not shown) can be used such as forced air to a register outlet as indicated at 17 or built-in means such as heating or cooling elements embedded in the walls of the respective areas. Also, if the system of the present invention is built into a standard building such as florist shop, either heated air, cooled air or both could be ducted from the building into the areas of the system of the present invention thus eliminating separate heating and cooling units therein.

Since some types of plants and flowers such as poinsettias require warmer temperatures than others, the heated area 11 shown in FIG. 3 includes a solid vertical partition 13' in the middle thereof. The horizontal partitions between the upper and lower cubicles would, of course, be meshed to allow air circulation but by having the solid partition 13' in the heated area, heated cubicles adjacent the cooled area will be not quite as warm as the cubicles farthest from the cooled area thus allowing a greater variety of temperatures to be available in which to place different types of plants and flowers. If, of course, only a heated and a cooled area is desired, wall 13' could be changed to the composite glass and mesh partitions indicated at 14 and 15.

Each of the cubicles of the present invention includes a hinged door 17. Each of these doors contain sequential indicia 18. For the purposes of this description, the numbers 1 through 12 have been used.

Figure 4:
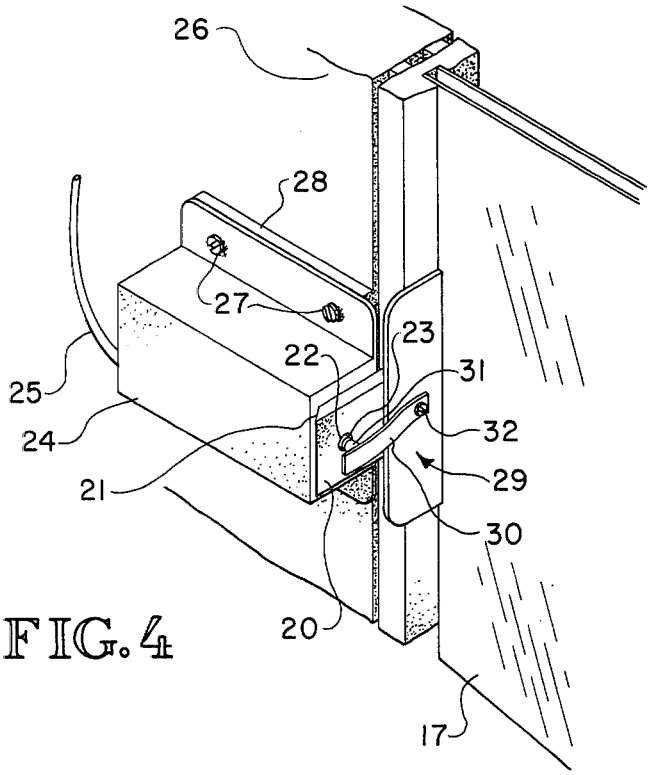
FIG. 4 is an enlarged fragmentary view of the locking and safety release portion of the present invention.
Figure 5:
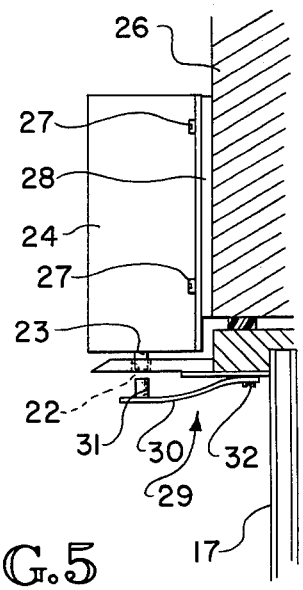
FIG. 5 is a sectional view taken through lines 5—5 of FIG. 4.

It should be noted from the Figures, particularly FIG. 4, that some of the cubicles are larger than others. The reason for this is that arrangements such as a dozen roses or a large poinsettia requires more space than a smaller less spread out arrangement. Thus flexibility is built into the system whereby both large and small arrangements can be displayed and sold without wasting space and heating and cooling energy.

The doors 17 are hinged in a conventional manner such as on pins 19. On the vertical edges of each of the doors 17 opposite hinge 19 is fixedly secured a latch plate 20. This plate is beveled at its outer edge 21 for the purposes hereinafter set forth. An opening 22 is provided in latch plate 20 to accommodate solenoid shaft 23 as again will hereafter be described in more detail.

A solenoid 40 of standard configuration and operation is contained within solenoid housing 24 and is activated through electrical connection 25. The solenoid is such that solenoid shaft 23 is outwardly extended from housing 24 when in the unenergized position and is retracted into such housing when in the energized condition.

Housing 24 is mounted on vertical frame member 26 by means such as screws 27. Because these screws are releasable fasteners, some adjustment is possible in the positioning of housing 24 thus assuring proper alignment of solenoid shaft 23 with latch plate opening 22. Shims or spacers 28 can, of course, be used as necessary to additionally allow for proper alignment of the shaft and opening.

Each of the doors 17 is preferably biased by a suitable means (not shown) toward the closed position so that when a selection has been made and the plant or flower arrangement has been removed from the selected cubicle, the door will automatically close to maintain the internal pre-set temperature in the area in which said cubicle is located.

On the unlikely circumstance that a person would become trapped inside one of the cubicles of the vending system of the present invention, an interiorly operated safety release mechanism, indicated generally at 29, is provided. This mechanism is preferably an elongated member formed from spring steel with a plunger portion 32 fixedly secured thereto. This plunger is longitudinally aligned with opening 22 in latch plate 20 and is of a length equal to more greater than the thickness of said latch plate 20. The safety release 29 is held in proper aligned position by means such as screw 32. Thus it can be seen that in case someone becomes locked inside one of the cubicles, all that is necessary is to push the outer edge of the elongated portion 30 and plunger 31 will pass through opening 22 to retract solenoid shaft 23 from latch plate 20 thus allowing the door 17 to be opened.

Referring more specifically to the control mechanism of the present invention, an electronic paper money reader 33, commonly referred to as a validator, is provided. These units are commercially available and are in wide use at self-service service stations as well as token machines in the search room of the Patent and Trademark Office. OwenBarbot, Inc. of Raleigh, North Carolina, produces and commercially sells a validator that can read and thus accept both one and five dollar bills. Although other validators would obviously work equally as well, this is the type of unit being used in connection with the preferred embodiment of the present invention.

The validator is electronically connected to a remote programming panel 34 which contains a plurality of settable dial circuits 35. Each of these dials has a predetermined number of indicia 36, one to twenty-four being illustrated which is the equivalent of one to twenty-four dollars.

The remote programming panel is, of course, removed from the customer area 37 and preferably would be behind a control panel door (not shown) which is lockable with either a key or combination lock.

Each of the dial circuits 35 on the remote panel 34 is connected to a corresponding selection button 38 which is on the customer operated selection panel 39. Each of the buttons 38 is preferably connected to an illuminating means so that it can be readily determined which selections have already been made and sold and which are still available. Each of the selection buttons 38 corresponds to one of the cubicle doors 17. The sequential indicia 18 would be used in correlating the numbers, as for example one through twelve, since this is the number of cubicles shown in FIG. 1. It is, of course, understood that more or less cubicles could be included in any given system depending on the needs and desires of the person installing the same.

Each of the selection buttons 38 are electrically connected to a solenoid 40 within solenoid housing 24 that corresponds to said button's numbered cubicle door 17.

To operate the vending system of the present invention, the customer (not shown) views through the transparent door 17 the florist product within the cubicle and reads thereon the price tag. The customer then places the corresponding number of one and/or five dollar bills (or other denominations should the validator be designed to accommodate the same) into vaidator 33. If the money is accepted as genuine, the validator will take the money and register a credit to the total amount fed thereinto. A pulse is then sent out from the validator for the amount received by it and whichever of the settable dial circuits 35 that has a setting corresponding to the amount received by the validator 33 will be energized. Since more than one selection can be priced at the same amount, on occasion more than one of the dial circuits 35 will be energized at the same time. Customer then presses the desired selection button 38 corresponding to the cubicle having the same number. So long as the setting on the dial circuit 35 corresponds to the amount received by validator 33, then the pressing of selection button 38 will allow current to flow to solenoid 40. When this solenoid is energized, solenoid shaft 23 will retract thus allowing door 17 to be opened.

To prevent the entire system from being tied up more than a predetermined length of time, a timer 41 has been indicated as being incorporated into the line between button 38 and solenoid 40. From experience, it has been found that a one minute time interval is adequate for the customer to open the selected door for removal of his purchase. Once the door is open, the fact that solenoid shaft 23 moves into the locked position will not have any effect since the latch plate connected to door 17 will be in a remote open position.

Once the purchase has been removed from the cubicle, the door 17 is released and the biasing means (not shown) closes the same. As the bevel portion 21 of latch plate 20 strikes solenoid shaft 23 (presuming the shaft has returned to its normal outwardly extending position) such shaft will be pushed inwardly and slide along the latch plate until it is in such a position as to projectingly engage opening 22 thus again locking door 17.

If, of course, door 17 has returned to its closed position prior to the timed sequence ending, when the timed sequence does expire the solenoid shaft will simply move outwardly and into the opening 22 to lock door 17.

Although timer 41 has been indicated as between the selection button 38 and the solenoid 40, it is understood, of course, that it could be located in any place in the control circuit as long as the desired results are accomplished.

The solenoid housing 24 is so constructed that it acts as a sound amplifier when solenoid 40 is energized. Thus the inherent buzzing sound of the energized solenoid will be amplified to an audible level so that the customer, once he has made his selection, is reminded which hinged door to open to remove his selected florist product.

A manual three-position switch 42 is provided on remote programming panel 34. The central position is indicated as "off" which shuts down the entire vending system and all doors will, of course, remain in the locked position. The "automatic" position of switch 42 energizes the validator circuit thus placing the entire system in the operational mode hereinabove described. For purposes of refilling the cubicles, cleaning the same or for other reasons, switch 42 can be placed in the "manual" position which by-passes the validator 33 and the dial circuits 35 thus the selection buttons will operate their respective solenoids without regard to money being placed in the validator.

The selection buttons 38 are so constructed that once any given button has been pushed and that circuit activated, it cannot be accidentally pushed again since it is presumed that the florist product within the given cubicle would already be removed. To further aid the customer, the light within the selection button 38 will go out once the same has been pushed thus further eliminating the possibility of an erroneous selection with no product received.

One final feature that is built into the control system of the present invention, and which is considered within the ability of those skilled in the art when given the disclosure of the present invention, is that regardless of which buttons 38 have been energized and which have not, once switch 42 is moved to the "off" position and then back to either "manual" or "automatic" positions, all systems recycle and are in condition for selective operation.

A power on indicator light 43 is provided on programming panel 34 so that operational mode can be determined. Should there be a power failure, this light, of course, would be inoperative thus indicating such condition to the agent tending the vending system.

From the above, it is obvious that the system of the present invention provides a simple and yet highly efficient means for providing vended florist products to customers in an easy to operate, relatively foolproof environment. The present vending system also has the advantage of providing an extremely simple interior safety latch release so that should a person accidentally become locked inside one of the cubicles, he can readily open the door and get out. A further advantage of the present invention is the simplicity with which the attendant can change the price of the products being vended by simply changing the settable dial for the cubicle circuit in question.

The present invention may, of course, be carried out in other specific ways than those herein set forth without departing from the spirit and essential characteristics of the invention. The present embodiments are, therefore, to be considered in all respects as illustrative and not restrictive and all changes coming within the meaning and equivalency range of the appended claims are intended to be embraced therein.

What is claimed is:

1. A product type vending system operable by a customer, comprising: a plurality of enclosed cubicles capable of containing a product; an access door operatively associated with each of said cubicles and movable between an open and a closed position for respectively permitting and denying outside access to said associated cubicle; a controllable locking means operatively associated with each of said doors for preventing, when in a locking condition, the corresponding door from being opened and for permitting, when in an unlocking condition, the corresponding door to be opened; a validator means for accepting and totaling money placed therein by the customer; a plurality of selector means individual to each locking means accessible to the customer and operatively connected between said validator means and each of said locking means for actuating said locking means when operated and thereby unlocking the corresponding door; and a plurality of variably adjustable control means individual to said selector means and unaccessible to the customer, said control means operatively connected to said selector means for permitting the operation thereof based on an adjustment of said control means corresponding to the desired amount of money to purchase the product contained in the corresponding one of said cubicles, whereby when the predetermined amount of money is paid into the validator and a selector means is operated, the associated locking means thereof will operatively release the associated door so that the product within the selected cubicle can be removed; said validator, said selector means, and said locking means being electrically operated; and said locking means comprising a solenoid and solenoid mounting means which, when said solenoid is energized, vibrates so as to produce an audible sound to indicate to the customer which door is to be opened.

2. The vending system of claim 1 wherein said locking means further includes a mechanical safety release means operable from inside the corresponding cubicle for unlocking said locking means.

3. A product type vending system operable by a customer, comprising: a plurality of enclosed cubicles capable of containing a product; an access door operatively associated with each of said cubicles and movable between an open and a closed position for respectively permitting and denying outside access to said associated cubicle; a controllable locking means operatively associated with each of said doors for preventing, when in a locking condition, the corresponding door from being opened and for permitting, when in an unlocking condition, the corresponding door to be opened; a validator means for accepting and totaling money placed therein by the customer; a plurality of selector means individual to each locking means accessible to the customer and operatively connected between said validator means and each of said locking means for actuating said locking means when operated and thereby unlocking the corresponding door; and a plurality of variably adjustable control means individual to said selector means and unaccessible to the customer, said control means operatively connected to said selector means for permitting the operation thereof based on an adjustment of said control means corresponding to the desired amount of money to purchase the product contained in the corresponding one of said cubicles, whereby when the predetermined amount of money is paid into the validator and a selector means is operated, the associated locking means thereof will operatively release the associated door so that the product within the selected cubicle can be removed; wherein a means is provided for free circulation of air between adjacent cubicles.

4. A product type vending system operable by a customer, comprising: a plurality of enclosed cubicles capable of containing a product; an access door operatively associated with each of said cubicles and movable between an open and a closed position for respectively permitting and denying outside access to said associated cubicle; a controllable locking means operatively associated with each of said doors for preventing, when in a locking condition, the corresponding door from being opened and for permitting, when in an unlocking condition, the corresponding door to be opened; a validator means for accepting and totaling money placed therein by the customer; a plurality of selector means individual to each locking means accessible to the customer and operatively connected between said validator means and each of said locking means for actuating said locking means when operated and thereby unlocking the corresponding door; and a plurality of variably adjustable control means individual to said selector means and unaccessible to the customer, said control means operatively connected to said selector means for permitting the operation thereof based on an adjustment of said control means corresponding to the desired amount of money to purchase the product contained in the corresponding one of said cubicles, whereby when the predetermined amount of money is paid into the validator and a selector means is operated, the associated locking means thereof will operatively release the associated door so that the product within the selected cubicle can be removed; part of the plurality of cubicles being heated and part of the plurality of cubicles being cooled.

5. A product type vending system operable by a customer, comprising: a plurality of enclosed cubicles capable of containing a product; an access door operatively associated with each of said cubicles and movable between an open and a closed position for respectively permitting and denying outside access to said associated cubicle; a controllable locking means operatively associated with each of said doors for preventing, when in a locking condition, the corresponding door from being opened and for permitting, when in an unlocking condition, the corresponding door to be opened; a validator means for accepting and totaling money placed therein by the customer; a plurality of selector means individual to each locking means accessible to the customer and operatively connected between said validator means and each of said locking means for actuating said locking means when operated and thereby unlocking the corresponding door; and a plurality of variably adjustable control means individual to said selector means and unaccessible to the customer, said control means operatively connected to said selector means for permitting the operation thereof based on an adjustment of said control means corresponding to the desired amount of money to purchase the product contained in the corresponding one of said cubicles, whereby when the predetermined amount of money is paid into the validator and a selector means is operated, the associated locking means thereof will operatively release the associated door so that the product within the selected cubicle can be removed; said operated locking means relocking after a predetermined time interval.

6. The vending system of claim 5 wherein the time interval is up to one minute.

* * * * *

US004311227B1

REEXAMINATION CERTIFICATE (3296th)

United States Patent [19] [11] B1 4,311,227

Watkins [45] Certificate Issued Aug. 12, 1997

[54] VENDING SYSTEM FOR FLORAL TYPE PRODUCTS

[75] Inventor: Kenneth M. Watkins, Raleigh, N.C.

[73] Assignee: 24 Hour Flower Limited, Brentwood, Tenn.

Reexamination Request:
No. 90/004,185, Mar. 18, 1996

Reexamination Certificate for:

| | |
|---|---|
| Patent No.: | **4,311,227** |
| Issued: | **Jan. 19, 1982** |
| Appl. No.: | **119,402** |
| Filed: | **Feb. 7, 1980** |

Related U.S. Application Data

[63] Continuation of Ser. No. 858,091, Dec. 8, 1977, abandoned.

[51] Int. Cl.[6] ..... G07F 7/04

[52] U.S. Cl. ..... 194/206; 221/5

[58] Field of Search ..... 221/3, 5, 69, 150 HC; 194/206, 207, 220–223, 225–227, 215–218

[56] References Cited

U.S. PATENT DOCUMENTS

| | | | |
|---|---|---|---|
| 1,435,441 | 11/1922 | Zsoldos . | |
| 2,617,267 | 11/1952 | Long | 62/102 |
| 2,701,746 | 5/1955 | Piggott | 312/215 |
| 2,800,988 | 8/1957 | Timms | 194/220 |
| 2,808,918 | 10/1957 | Shepard, Jr. et al. | 194/247 |
| 2,811,403 | 10/1957 | Barker | 312/97.1 |
| 2,865,698 | 12/1958 | Smith | 312/35 |
| 3,443,675 | 5/1969 | Yamamoto et al. | 194/210 |
| 3,791,505 | 2/1974 | Mandell | 194/217 |
| 3,796,294 | 3/1974 | Hoffer et al. | 194/219 |
| 3,826,344 | 7/1974 | Wahlberg | 194/206 |
| 3,866,795 | 2/1975 | Urano | 221/150 |

*Primary Examiner*—F. J. Bartuska

[57] ABSTRACT

This invention is a vending system for floral type products and includes a plurality of product containing cubicles with an access door operatively associated with each. A controllable locking structure is used with each door and is connected to a validator for accepting and totaling money. Selectors are provided for choosing the appropriate cubicle door to be opened and these selectors are resettable to a different amount of money by simply resetting a dial on the exterior backside of the panel.

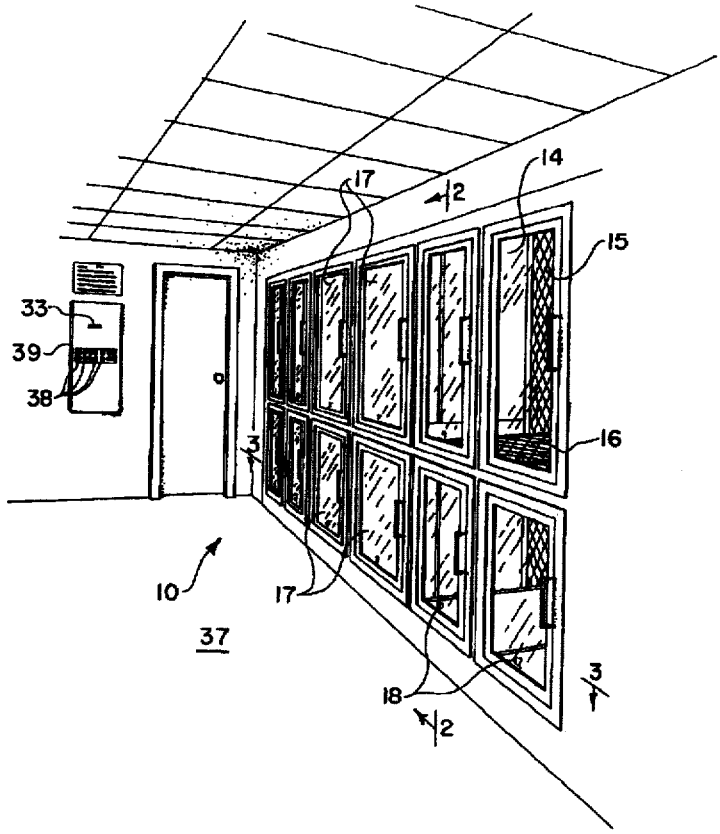

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 3, 4 and 5 are determined to be patentable as amended.

Claims 2 and 6, dependent on an amended claim, are determined to be patentable.

New claims 7 and 8 are added and determined to be patentable.

1. A product type vending system operable by a customer, comprising:

a plurality of enclosed cubicles capable of containing a product;

an access door operatively associated with each of said cubicles and movable between an open and a closed position for respectively permitting and denying outside access to said associated cubicle;

a controllable locking means operatively associated with each of said doors for preventing, when in a locking condition, the corresponding door from being opened and for permitting, when in an unlocking condition, the corresponding door to be opened;

a validator means for accepting and totaling money placed therein by the customer;

a plurality of selector means individual to each locking means accessible to the customer and operatively connected between said validator means and each of said locking means for actuating said locking means when operated and thereby unlocking the corresponding door;

[and] a plurality of variably adjustable control means individual to said selector means and unaccessible to the customer, said control means *being* operatively connected to said selector means for permitting the operation thereof based on an adjustment of said control means corresponding to the desired amount of money to purchase the product contained in the corresponding one of said cubicles[,] whereby when the predetermined amount of money is paid into [the] *said* validator *means* and a selector means is operated, the associated locking means thereof will operatively release the associated door so that the product within the selected cubicle can be removed;

said validator *means*, said selector means, and said locking means being electrically operated; and said locking means comprising a solenoid and solenoid mounting means which, when said solenoid is energized, [vibrates] *functions to amplify the inherent sound of said energized solenoid* so as to produce an audible sound to indicate to the customer which door is to be opened.

3. A product type vending system operable by a customer, comprising:

a plurality of enclosed cubicles capable of containing a product;

an access door operatively associated with each of said cubicles and movable between an open and a closed position for respectively permitting and denying outside access to said associated cubicle;

a controllable locking means operatively associated with each of said doors for preventing, when in a locking condition, the corresponding door from being opened and for permitting, when in an unlocking condition, the corresponding door to be opened, *said locking means comprising a solenoid and solenoid mounting means which, when said solenoid is energized, functions to amplify the inherent sound of said energized solenoid so as to produce an audible sound to indicate to the customer which door is to be opened*;

a validator means for accepting and totaling money placed therein by the customer;

a plurality of selector means individual to each locking means accessible to the customer and operatively connected between said validator means and each of said locking means for actuating said locking means when operated and thereby unlocking the corresponding door;

[and] a plurality of variably adjustable control means individual to said selector means and unaccessible to the customer, said control means *being* operatively connected to said selector means for permitting the operation thereof based on an adjustment of said control means, corresponding to the desired amount of money to purchase the product contained in the corresponding one of said cubicles[,] whereby when the predetermined amount of money is paid into [the] *said* validator *means* and a selector means is operated, the associated locking means thereof will operatively release the associated door so that the product within the selected cubicle can be removed; *and*

[wherein a] *air circulation* means [is provided] for *providing* free circulation of air between adjacent cubicles.

4. A product type vending system operable by a customer, comprising:

a plurality of enclosed cubicles capable of containing a product, *part of said plurality of cubicles being heated and part of said plurality of cubicles being cooled*;

an access door operatively associated with each of said cubicles and movable between an open and a closed position for respectively permitting and denying outside access to said associated cubicle;

a controllable locking means operatively associated with each of said doors for preventing, when in a locking condition, the corresponding door from being opened and for permitting, when in an unlocking condition, the corresponding door to be opened, *said locking means comprising a solenoid and solenoid mounting means which, when said solenoid is energized, functions to amplify the inherent sound of said energized solenoid so as to produce an audible sound to indicate to the customer which door is to be opened*;

a validator means for accepting and totaling money placed therein by the customer;

a plurality of selector means individual to each locking means accessible to the customer and operatively connected between said validator means and each of said locking means for actuating said locking means when operated and thereby unlocking the corresponding door;

[and] a plurality of variably adjustable control means individual to said selector means and unaccessible to the customer, said control means *being* operatively connected to said selector means for permitting the operation thereof based on an adjustment of said control means corresponding to the desired amount of money to purchase the product contained in the corresponding one of said cubicles[,] whereby when the predetermined amount of money is paid into [the] *said* validator *means* and a selector means is operated, the associated locking means thereof will operatively release the associated door so that the product within the selected cubicle can be removed[; part of the plurality of cubicles being heated and part of the plurality of cubicles being cooled].

5. A product type vending system operable by a customer, comprising:

a plurality of enclosed cubicles capable of containing a product;

an access door operatively associated with each of said cubicles and movable between an open and a closed position for respectively permitting and denying outside access to said associated cubicle;

a controllable locking means operatively associated with each of said doors for preventing, when in a locking condition, the corresponding door from being opened and for permitting, when in an unlocking condition, the corresponding door to br opened;

a validator means for accepting and totaling money placed therein by the customer;

a plurality of selector means individual to each locking means accessible to the customer and operatively connected between said validator means and each of said locking means for actuating said locking means when operated and thereby unlocking the corresponding door;

[and] a plurality of variably adjustable control means individual to said selector means and unaccessible to the customer, said control means *being* operatively connected to said selector means for permitting the operation thereof based on an adjustment of said control means corresponding to the desired amount of money to purchase the product contained in the corresponding one of said cubicles[,] whereby when the predetermined amount of money is paid into [the] *said* validator *means* and a selector means is operated, the associated locking means thereof will operatively release the associated door so that the product within the selected cubicle can be removed; said operated locking means relocking *automatically* after a predetermined time interval.

*7. A product type vending system operable by a customer, comprising:*

*a plurality of enclosed cubicles capable of containing a product;*

*an access door operatively associated with each of said cubicles and movable between an open and a closed position for respectively permitting and denying outside access to said associated cubicle;*

*a controllable locking means operatively associated with each of said doors for preventing when in a locking condition, the corresponding door from being opened and for permitting, when in an unlocking condition, the corresponding door to be opened, said controllable locking means relocking automaticaly after a predetermined time interval;*

*a validator means for accepting and totaling money placed therein by the customer;*

*a plurality of selector means individual to each locking means accessible to the customer and operatively connected between said validator means and each of said locking means for actuating said locking means when operated and thereby unlocking the corresponding door;*

*a plurality of variable adjustable control means individual to said selector means and unaccessible to the customer, said control means being operatively connected to said selector means for permitting the operation thereof based on an adjustment of said control means corresponding to the desired amount of money to purchase the product contained in the corresponding one of said cubicles whereby when the predetermined amount of money is paid into said validator means and a selector means is operated, the associated locking means thereof will operatively release the associated door so that the product within the selected cubicle can be removed; and*

*air circulation means for providing free circulation of air between adjacent cubicles.*

*8. A product type vending system operable by a customer, comprising: a plurality of enclosed cubicles capable of containing a product, part of said plurality of cubicles being heated and part of said plurality of cubicles being cooled;*

*an access door operatively associated with each of said cubicles and movable between an open and a closed position for respectively permitting and denying outside access to said associataed cubicle;*

*a controllable locking means operatively associated with each of said doors for preventing, when in a locking condition, the corresponding door from being opened and for permitting, when in an unlocking condition, the corresponding door to be opened, said controllable locking means relocking automatically after a predetermined time interval;*

*a validator means for accepting and totaling money placed therein by the customer,*

*a plurality of selector means individual to each locking means accessible to the customer and operatively connected between said validator means and each of said locking means for actuating said locking means when operated and thereby unlocking the corresponding door; and*

*a plurality of variably adjustable control means individual to said selector means and unaccessible to the customer, said control means being operatively connected to said selector means for permitting the operation thereof based on an adjustment of said control means corresponding to the desired amount of money to purchase the product contained in the corresponding one of said cubicles whereby when the predetermined amount of money is paid into said validator means and a selector means is operated, the associated locking means thereof will operatively release the associated door so that the product within the selected outside can be removed.*

* * * * *